US008820367B2

(12) United States Patent
Reyes

(10) Patent No.: US 8,820,367 B2
(45) Date of Patent: Sep. 2, 2014

(54) ACTIVITY AND STORAGE BAG

(76) Inventor: Cathi Reyes, Temecula, CA (US)

( * ) Notice: Subject to any disclaimer, the term of this patent is extended or adjusted under 35 U.S.C. 154(b) by 222 days.

(21) Appl. No.: 12/634,658

(22) Filed: Dec. 9, 2009

(65) Prior Publication Data

US 2011/0132507 A1 Jun. 9, 2011

(51) Int. Cl.

| | |
|---|---|
| ***A45C 13/00*** | (2006.01) |
| ***A45C 1/06*** | (2006.01) |
| ***A45C 11/18*** | (2006.01) |
| ***A45C 13/30*** | (2006.01) |
| ***A45C 1/02*** | (2006.01) |

(52) U.S. Cl.

USPC ..... 150/106; 150/131; 206/542; 206/545; 220/239; 224/148.4

(58) Field of Classification Search

USPC ..... 150/106, 131, 107, 112, 138.149; 224/148.3, 148.4, 575, 148.1; 215/389, 215/395; 206/542, 216, 217, 545, 547; 220/737, 902; 383/38

See application file for complete search history.

(56) References Cited

U.S. PATENT DOCUMENTS

| | | | | | |
|---|---|---|---|---|---|
| 3,614,875 | A * | 10/1971 | McCallun | 383/38 |
| 4,401,245 | A * | 8/1983 | Zills | 224/148.3 |
| D292,646 | S * | 11/1987 | Pitini et al. | D3/303 |
| 5,255,835 | A * | 10/1993 | Burks | 224/666 |
| 5,431,316 | A * | 7/1995 | Garcia et al. | 224/585 |
| 6,971,562 | B2 * | 12/2005 | Willows et al. | 224/148.4 |
| 7,252,213 | B1 * | 8/2007 | DeSanto | 224/148.7 |
| 7,556,073 | B2 * | 7/2009 | Lyons | 150/132 |
| 7,571,752 | B1 * | 8/2009 | Donohoe | 150/134 |
| 2001/0027834 | A1 * | 10/2001 | Southwick | 150/108 |
| 2006/0157525 | A1 * | 7/2006 | Furlong et al. | 224/601 |
| 2007/0080182 | A1 * | 4/2007 | Thatcher | 224/148.4 |
| 2007/0102077 | A1 * | 5/2007 | Parker-Ogden | 150/111 |
| 2007/0102460 | A1 * | 5/2007 | Lottman | 224/153 |
| 2008/0047990 | A1 * | 2/2008 | Morgan et al. | 224/222 |
| 2008/0149235 | A1 * | 6/2008 | Jay | 150/143 |
| 2008/0264745 | A1 * | 10/2008 | Tauchen | 190/111 |

* cited by examiner

*Primary Examiner* — Sue A Weaver

(74) *Attorney, Agent, or Firm* — Mintz Levin Cohn Ferris Glovsky and Popeo, P.C.

(57) ABSTRACT

An activity and storage bag is includes a central compartment for holding one or more removable objects. The central compartment has an inner surface that is water-resistant and an outer surface. The activity and storage bag further includes a wallet attached to the outer surface of the central compartment for storing wallet items. The wallet includes an external flap that folds out from and attaches back with an internal flap that is connected to the outer surface of the central compartment. The activity and storage bag further includes one or more side pockets attached to the outer surface of the central compartment adjacent to the wallet.

11 Claims, 7 Drawing Sheets

ACTIVITY AND STORAGE BAG

BACKGROUND

People who engage in activities usually have a number of items they must carry around with them. These items can include, without limitation, a purse, a water bottle, a wallet, mobile phone or other device, such as a digital media player, keys, small towel, paper planners, access cards, and credit cards. All of these items are sometimes tossed indiscriminately into a gym bag, backpack or other type of duffel bag, where they become difficult to locate, access or use. Additionally, where a water bottle is used, most bags lack an adequate compartment for effectively holding the water bottle, or for keeping the water bottle and its contents properly insulated.

SUMMARY

This document discloses an activity and storage bag that includes a number of pockets, compartments, and materials for storing, safeguarding and preserving the essential items a person needs for being active while negotiating their lifestyle.

In one aspect, an activity and storage bag is presented that includes a central compartment for holding one or more removable objects. The central compartment has an inner surface that is water-resistant and an outer surface. The activity and storage bag further includes a wallet attached to the outer surface of the central compartment for storing wallet items. The wallet includes an external flap that folds out from and attaches back with an internal flap that is connected to the outer surface of the central compartment. The activity and storage bag further includes one or more side pockets attached to the outer surface of the central compartment adjacent to the wallet. In some implementations, the activity and storage bag can include a strap coupled to the outer surface of the central compartment.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
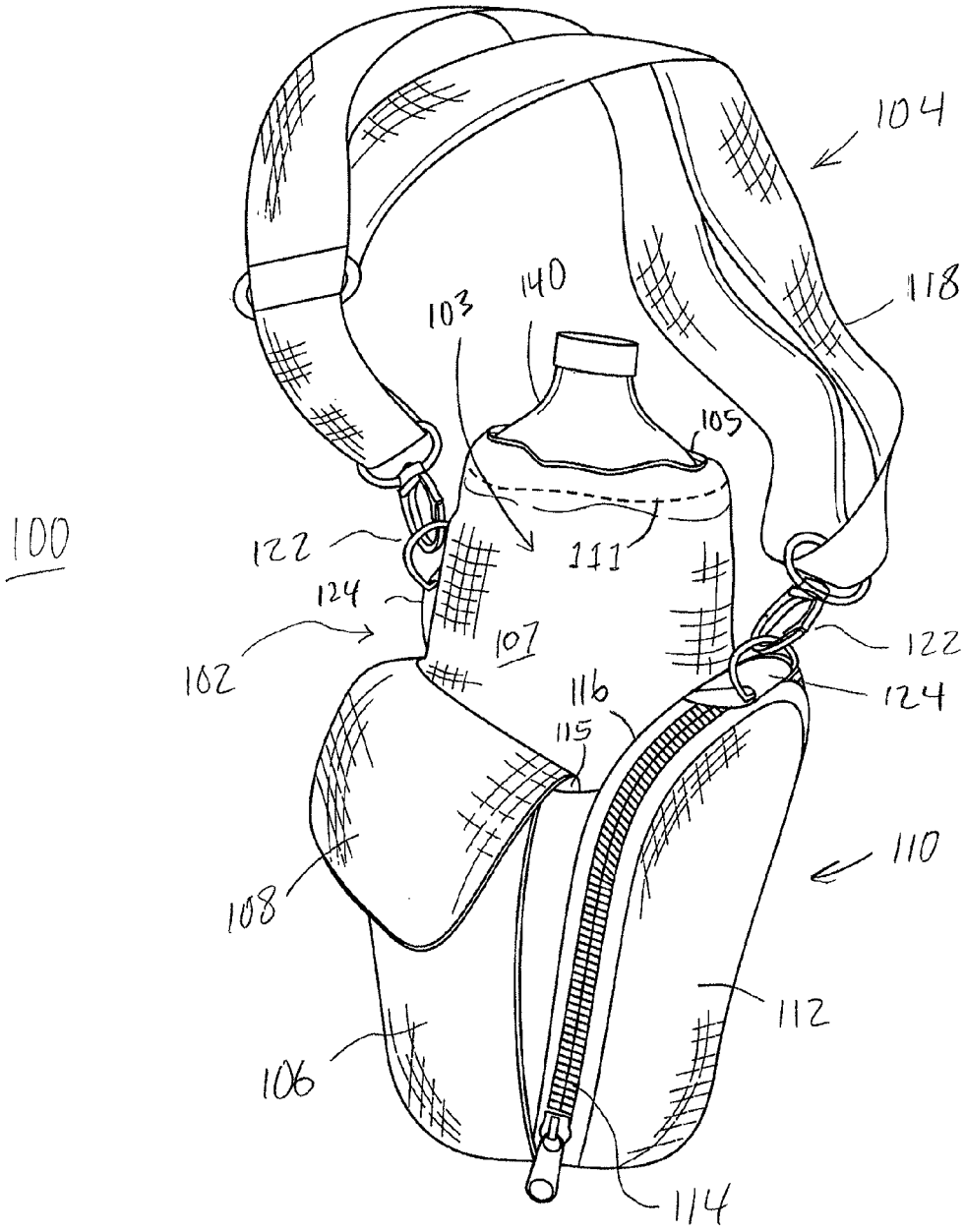
FIG. 1 is a perspective view of an activity and storage bag according to some implementations.
Figure 2:
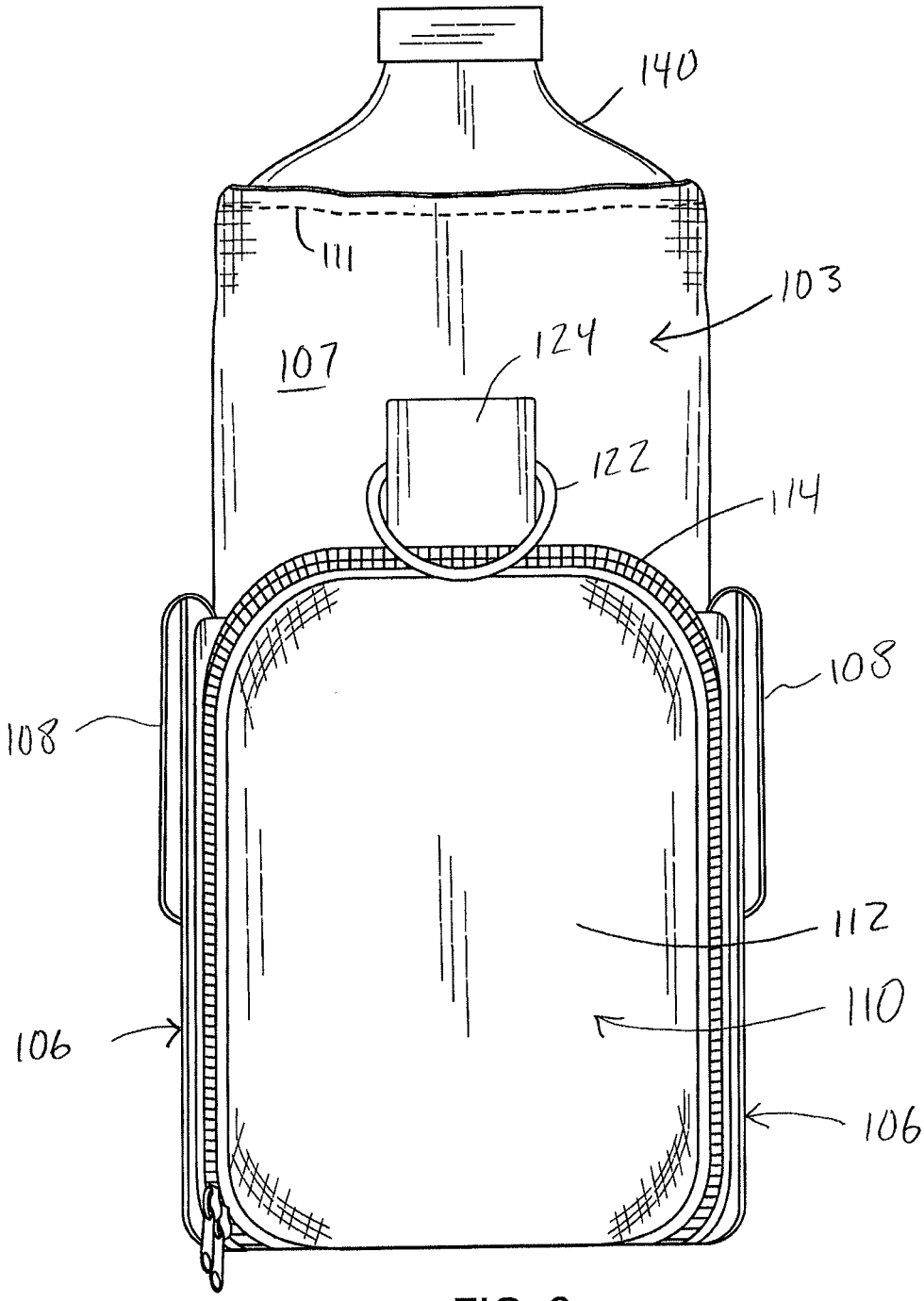
FIGS. 2-5 each show various one-quarter side views of the activity and storage bag.

This document describes a soft-sided yet durable activity and storage bag. In accordance with some preferred implementations, the activity and storage bag includes a combination of a wallet for storing wallet items, and a central compartment for holding removable objects such as a bottle or container. The central compartment is preferably water resistant or waterproof for storing a bottle that contains a liquid, such as water, juice or other drink. The activity and storage bag can include one or more straps, such as a shoulder strap or handle. The straps are preferably detachable and adjustable. The activity and storage bag can be made in any color or with any outer design or pattern.

FIGS. 1-5 illustrate various views of an activity and storage bag 100 in accordance with preferred implementations. The activity and storage bag 100 includes a bag component 102 and a strap component 104. The bag component 102 and the strap component 104 are preferably formed of a durable water resistant or waterproof material such as high denier nylon or other fabric with a PVC backing.

The bag component 102 includes a central compartment 103 that provides the basic shape and size of the bag component 102. The central compartment 103 includes an opening 105 that is preferably located at the top of the central compartment 103, and which can be closed and/or cinched tight around an object 140 placed therein by a threaded cord (not shown) or other closure mechanism 111, which can include buttons, zippers, hook and loop closures, preformed and deformable rigid members, or the like. The object 140 can be a bottle, a container, or any other removable object. In some implementations, the central compartment 103 has an interior space of 20 to 640 cubic inches, for holding a 0.32 to 10.5 liter sized bottle or other removable object.

The central compartment 103 includes an outer surface 107 and an inner surface 109. The inner surface 109 can be formed of a separate layer or material than the outer surface 107. For example, the inner surface 109 can be formed of a thin, pliable sheet such as PVC, coated nylon, or other plastic, that is formed as an enclosure with an opening. Alternatively, the inner surface 109 can include a rigid material, such as solid PVC or other plastic. The inner surface 109 can be lined or coated with a water impermeable material to inhibit liquids from soaking through to the outer surface 107 if spilled inside the central compartment 103. The outer surface 107 can be formed of denier nylon, and can include any color or pattern of colors that are desired.

The bag component 102 of the activity and storage bag 100 further includes one or more side pockets 106 that are sewn or otherwise attached to the outer surface 107 of the bag component 102 to form a pouch-like compartment. The side pockets 106 can be sized and adapted, i.e. expandable, to form a compartment to receive and hold one or more items, such as one or more diapers, a mobile phone, personal digital assistant, portable digital media player or other electronic device.

Each side pocket 106 can include a closure device such as a flap 108 that extends downward over an upper opening 115 of the side pocket 106 to at least partially close the upper opening 115 and which can be lifted to allow access to the side pocket 106 through the upper opening 115. Other closure devices that can be used for closing and securing the upper opening 115 include buttons, zippers, hook and loop fasteners, snaps, rivets, or other closure devices. One or more of the side pockets 106 can include one or more pouches or auxiliary compartments. The flaps 108 can be sewn or otherwise attached directly to the outer surface 107 of the bag component 102, or attached to an inner surface of the side pocket 106.

The bag component 102 of the activity and storage bag 100 further includes a wallet 110 connected to the outer layer 107 adjacent the one or more pockets 106. The wallet 110 includes a zippered closure 114 to close an external flap 112 in a closed configuration to an internal flap 116 that is sewn or otherwise attached to an outer surface of the outer layer 107. In the closed configuration, the wallet 110 can occupy one-quarter to one-third of the of the perimeter of a portion of the bag component 102, and one-third to two-thirds of the height of the bag component 102.

The strap component 104 of the activity and storage bag 100 can include one or more straps 118. The straps 118 can be shoulder straps for draping over a shoulder of a user, hanging straps for hanging on a knob, post or exercise machine, or handle straps for being carried in a user's hand. The straps 118 can be attached to the activity and storage bag 100 via rings 122 and/or loops 124 sewn to or otherwise attached to the outer surface 107. The rings 122 and/or loops 124 can be sized to be able to be threaded by a belt or cord.

Figure 3:
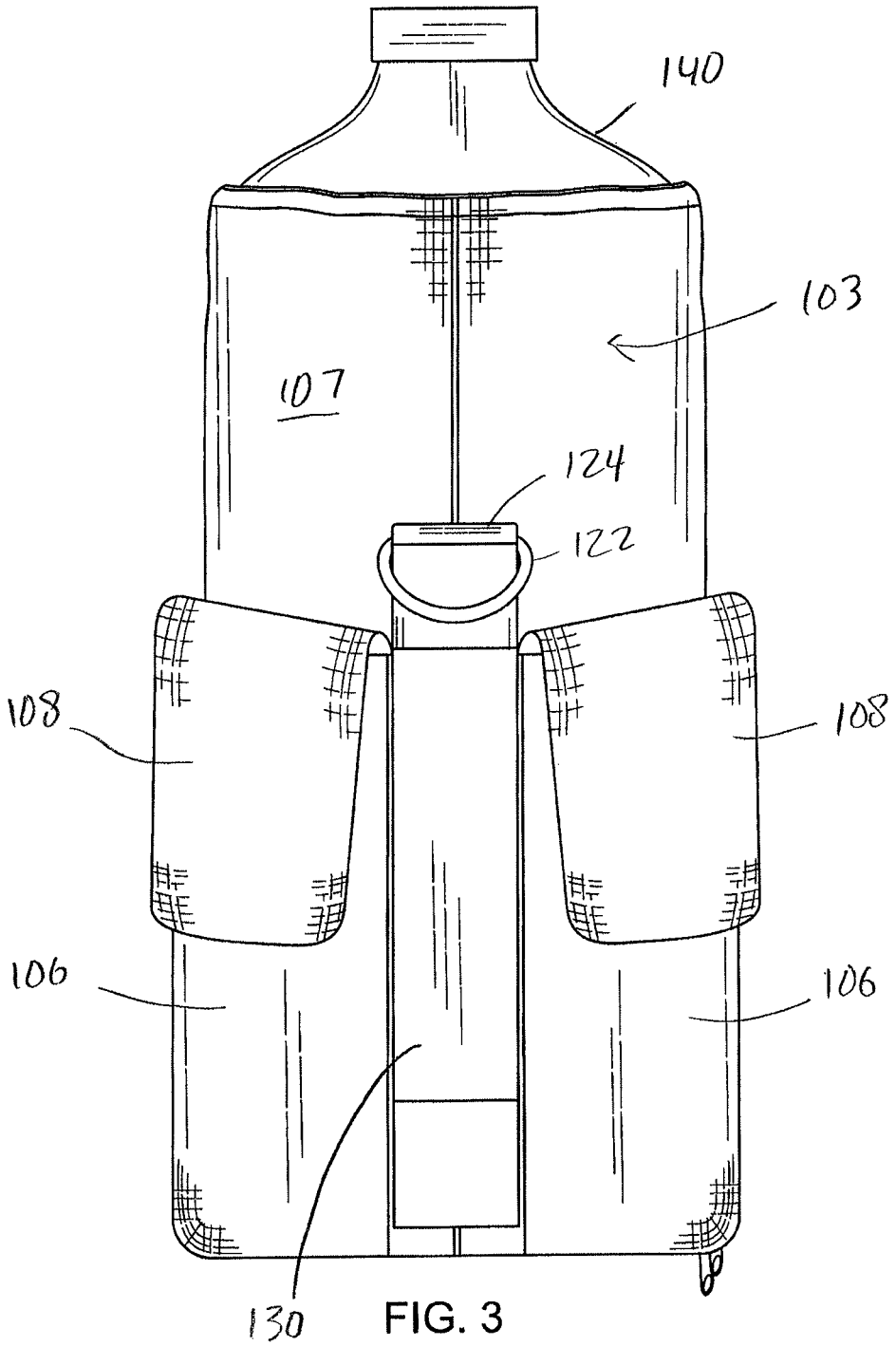
Figure 4:
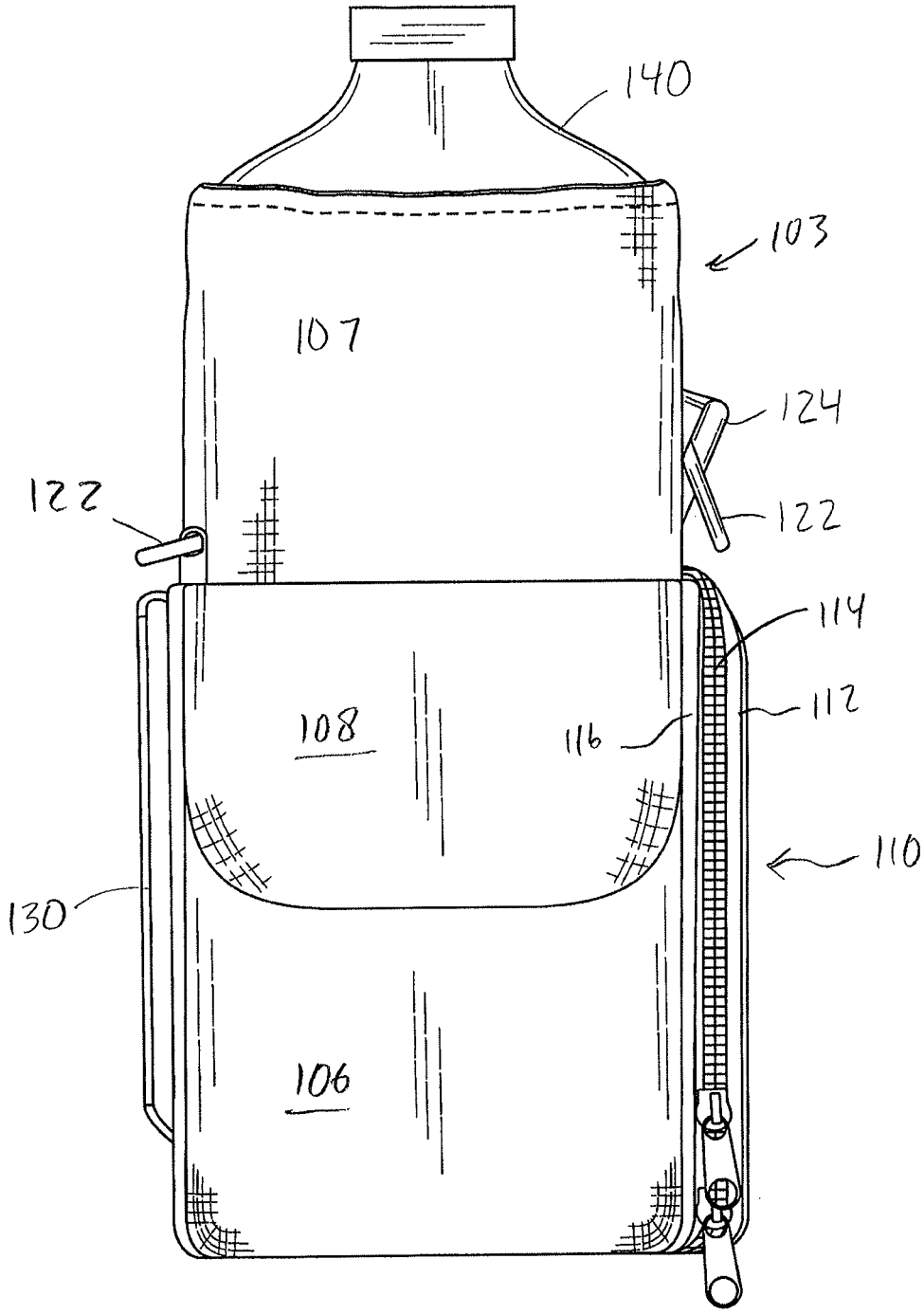
Figure 5:
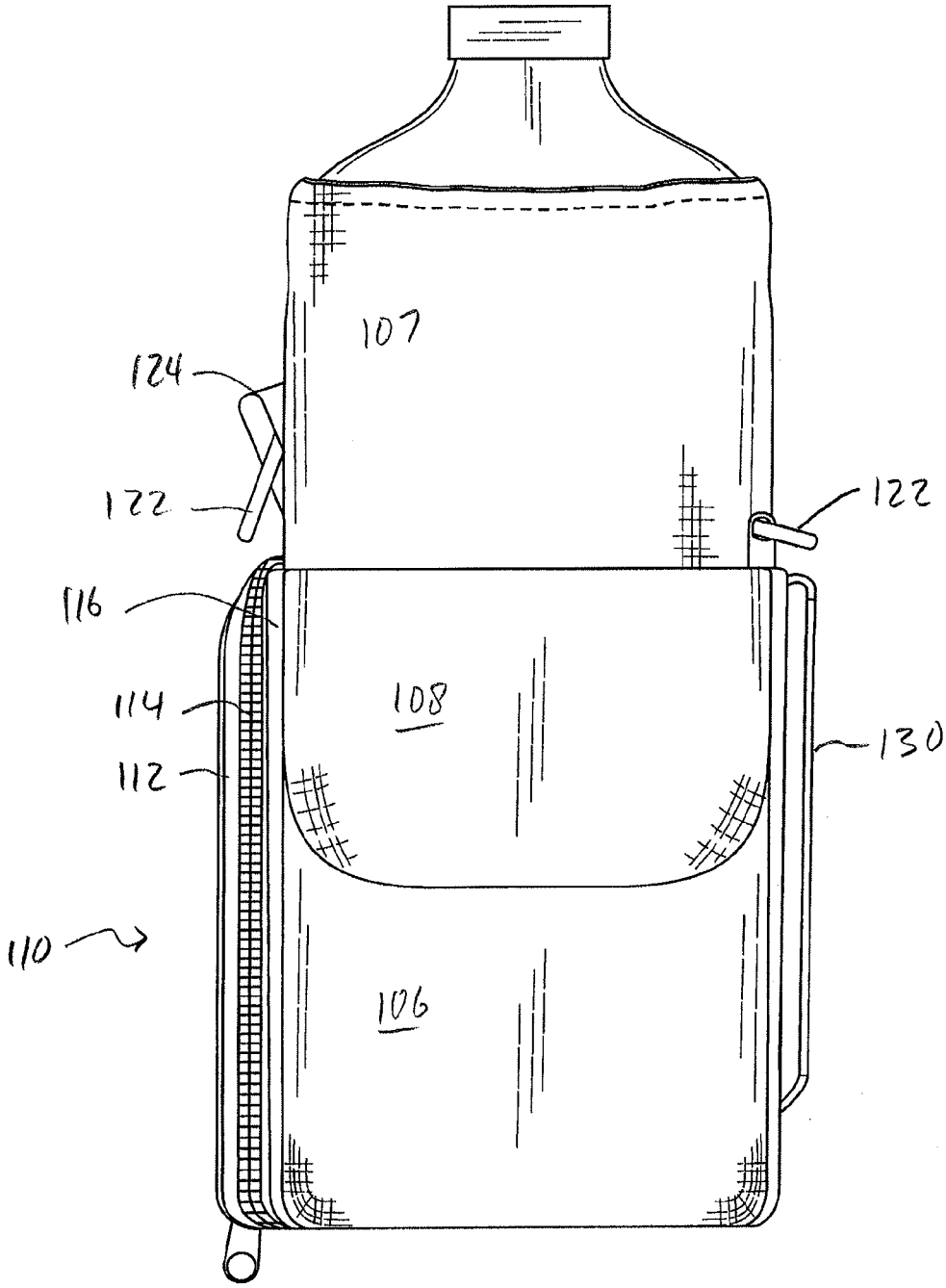

As shown in FIGS. 3-5, the activity and storage bag 100 can further include a side handle 130 that extends out from the outer surface 107. In some implementations, the side handle 130 is positioned between two side pockets 106, or between one side pocket 106 and the wallet 110. The side handle 130 enables a user to carry the activity and storage bag 100 without using the straps 118, or to maneuver the activity and storage bag 100 to access the object 140 within the central compartment 103, for example, without the user needing to remove the object 140.

Figure 6:
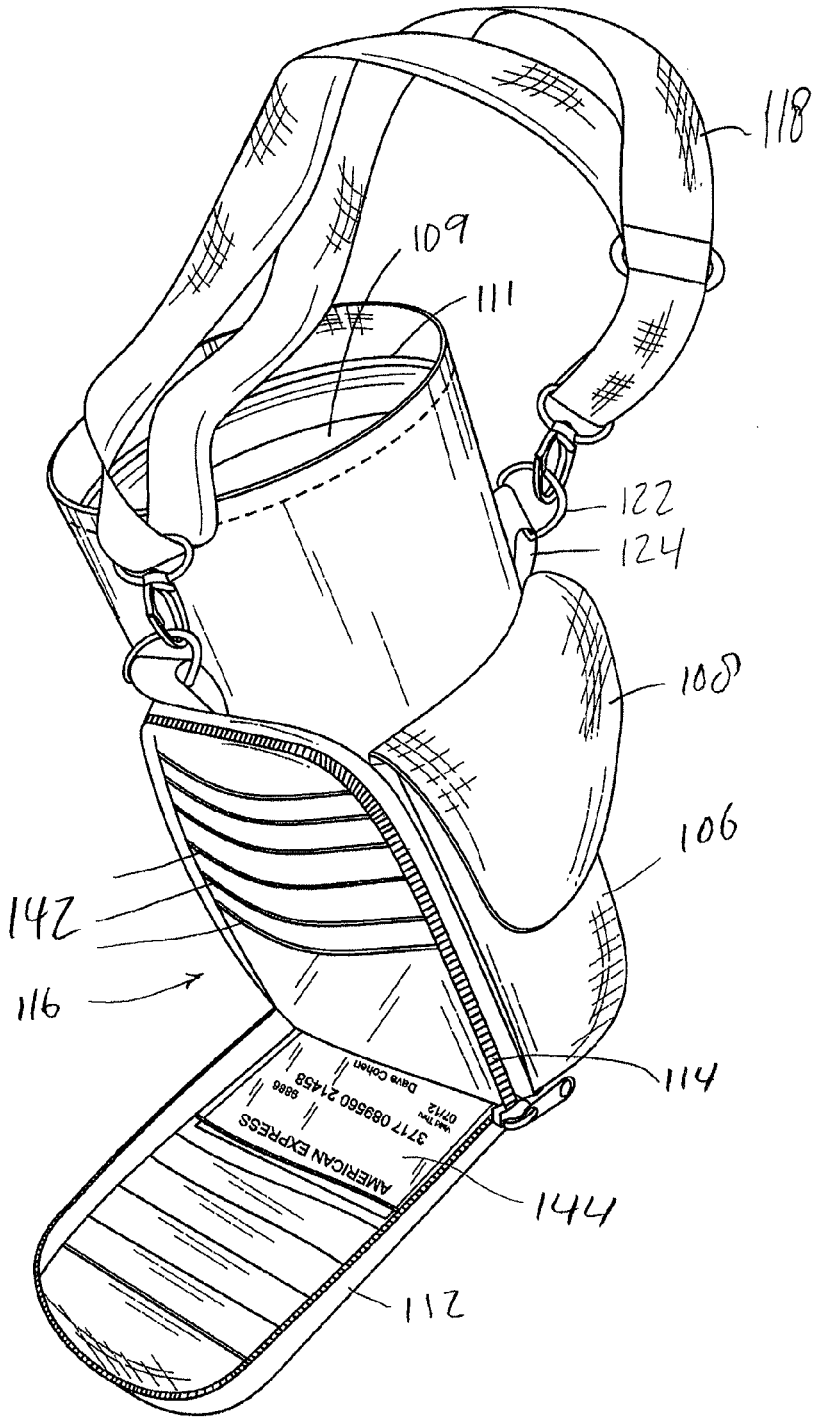
FIG. 6 illustrates the activity and storage bag in an opened configuration with an opened wallet.

FIG. 6 illustrates the activity and storage bag in an opened configuration with an opened wallet 110. The wallet 110 contains one or more slots 142 for holding credit or debit cards and/or identification cards, business cards, photographs, thin calculators or the like. In some exemplary implementations, the wallet 110 includes at least one clear slot 144 for receiving an displaying most of the face of a card or photograph inserted therein. In one particularly implementation, an inner surface of each of the external flap 112 and the internal flap 116 includes one clear slot, i.e. a slot having a clear window material, and one or more standard slots arranged in cascaded order along the inner surface of each flap 112, 116.

Figure 7:
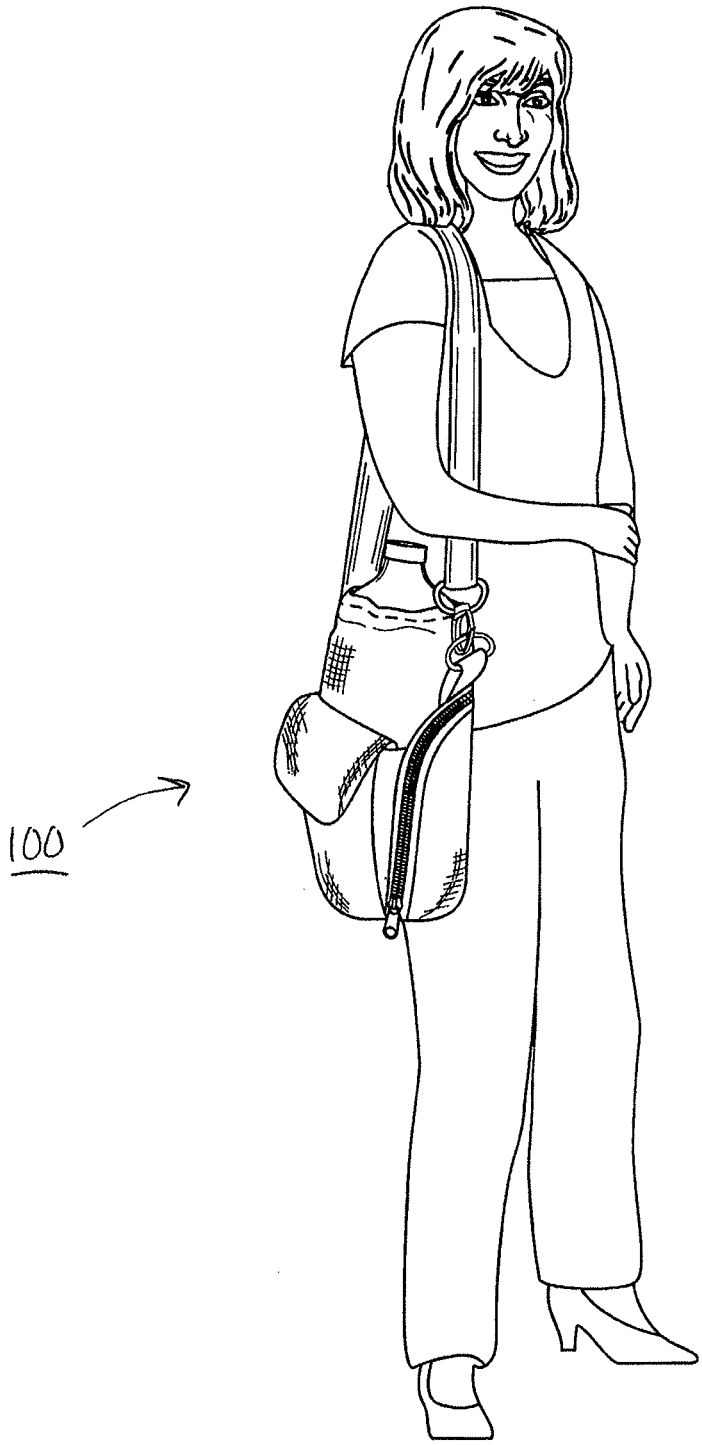
FIG. 7 illustrates an activity and storage bag in use.

FIG. 7 illustrates an activity and storage bag 100 in use, as carried over the shoulder of a user by its straps 118. The user has easy access to both the object 140 within the central compartment 103, as well as access to the wallet 110 and the one or more side pockets 106. In some implementations, the straps 118 can be adjusted to place the activity and storage bag 100 at a desirable position at the side of the user for comfort and access, as well as to orient the wallet 110 and/or side pockets 106 in a particular desired position.

Although a few embodiments have been described in detail above, other modifications are possible. For example, the activity and storage bag may include a side handle and not a strap. Or, the activity and storage bag may include more than one side handle. The outer surfaces of the activity and storage bag can bear graphics, colorings, or other design features. Other embodiments may be within the scope of the following claims.

The invention claimed is:

1. An activity and storage bag comprising:

a central compartment for holding one or more removable objects, the central compartment having an inner surface that is water-resistant and an outer surface;

a bottle for holding liquids, the bottle having an outer circumference that fits within the inner surface of the central compartment;

a wallet attached to the outer surface of the central compartment for storing wallet items, the wallet including an external flap that folds out from and attaches back with an internal flap that is connected to the outer surface of the central compartment, the wallet comprising two or more slots each of the two or more slots having a width for receiving one or more of an identification card and a bank card;

a strap coupled to the outer surface of the central compartment; and one or more side pockets attached to the outer surface of the central compartment adjacent to the wallet and the strap.

2. The activity and storage bag of claim 1, wherein the outer surface of the central compartment, the external flap and internal flap of the wallet, and the one or more side pockets are made of denier fabric.

3. The activity and storage bag of claim 2, wherein the denier fabric includes nylon.

4. The activity and storage bag of claim 1, wherein each of the one or more side pockets includes a flap that extends downward over an upper opening of the side pocket.

5. The activity and storage bag of claim 1, wherein the wallet is squared, and wherein the external flap is attached to the internal flap by a zipper that extends along three sides of the wallet.

6. The activity and storage bag of claim 1, wherein the wallet further includes at least one photograph slot.

7. An activity and storage bag comprising:

a central compartment for holding a bottle, the central compartment having an inner surface that is water-resistant and an outer surface, the central compartment comprising two or more slots, each of the two or more slots having a width for receiving one or more of an identification card and a bank card, the bottle having an outer circumference that fits within the inner surface of the central compartment;

a wallet attached to the outer surface of the central compartment for storing wallet items, the wallet including an external flap that folds out from and attaches back with an internal flap that is connected to the outer surface of the central compartment;

one or more side pockets attached to the outer surface of the central compartment adjacent to the wallet; and a strap coupled to the outer surface of the central compartment, the strap having an adjustable length.

8. The activity and storage bag of claim 7, wherein the outer surface of the central compartment, the external flap and internal flap of the wallet, the one or more side pockets, and the strap are made of nylon.

9. The activity and storage bag of claim 7, wherein each of the one or more side pockets includes a flap that extends downward over an upper opening of the side pocket.

10. The activity and storage bag of claim 7, wherein the wallet is squared, and wherein the external flap is attached to the internal flap by a zipper that extends along three sides of the wallet.

11. The activity and storage bag of claim 7, wherein the wallet further includes at least one photograph slot.

* * * * *